US005853012A

United States Patent [19]

Burns et al.

[11] Patent Number: 5,853,012

[45] Date of Patent: Dec. 29, 1998

[54] COSMETIC APPLICATOR

[76] Inventors: Michael Burns; Cameron Tappin, both of 407 Wethersfield Ave., Hartford, Conn. 06114

[21] Appl. No.: 877,493

[22] Filed: Jun. 17, 1997

Related U.S. Application Data

[63] Continuation-in-part of Ser. No. 839,144, Apr. 23, 1997.

[51] Int. Cl.[6] ..... A45D 40/26

[52] U.S. Cl. ..... 132/320; 132/317; 401/7

[58] Field of Search ..... 132/320, 319, 132/317, 316, 73, 286, 297, 318; 401/7; 2/21, 160, 163, 16; 15/167.1, 227

[56] References Cited

U.S. PATENT DOCUMENTS

| | | | |
|---|---|---|---|
| 1,297,784 | 3/1919 | Birnbaum | 401/7 |
| 2,002,144 | 5/1935 | Heaton | 401/7 |
| 2,511,557 | 6/1950 | Arnold | 401/7 |
| 2,621,784 | 12/1952 | Boythan | 401/7 |
| 4,213,472 | 7/1980 | Gueret et al. | 132/320 |
| 4,323,157 | 4/1982 | Idec | 132/318 |
| 5,502,863 | 4/1996 | Perkins | 401/7 |

*Primary Examiner*—Gene Mancene
*Assistant Examiner*—Pedro Philogene
*Attorney, Agent, or Firm*—McCormick, Paulding & Huber

[57] ABSTRACT

In a cosmetic applicator, a first resilient member having a first density is provided and includes a tip end, an exterior surface and a lower end. A second resilient member having a second density for retaining and depositing a cosmetic material is coupled to the first resilient member. The cosmetic applicator also prevents contamination of the user's hands by cosmetic material by providing an interior area defined by the first resilient member for receiving at least two fingers of the user. Alternatively, the first and second resilient members can be mounted on or in a sleeve that can be manipulated either by the user grasping the sleeve's exterior surface, or sliding at least two fingers into an interior area defined by the sleeve. A cap containing a cutter for trimming a tip portion of both the first and second resilient members can also be provided, thereby allowing the user to obtain a fresh clean application surface when desired.

23 Claims, 6 Drawing Sheets

COSMETIC APPLICATOR

CROSS REFERENCE TO RELATED APPLICATIONS

This patent application is a continuation-in-part of U.S. patent application Ser. No. 08/839,144, entitled "IMPROVED COSMETIC APPLICATOR", filed on Apr. 23, 1997 in the names of Michael Burns and Cameron Tappin, now pending.

FIELD OF THE INVENTION

The present invention relates generally to the application of cosmetics, and more particularly to the implements used in making such application.

BACKGROUND OF THE INVENTION

The present invention has particular utility in connection with the application of make-up and is described herein as applied to such use. In general, when a large area of a persons skin is to be covered with make up, for example foundation, a cosmetic sponge is used to effect its application. These sponges are generally hand-held, with the make-up being transferred to the sponge via the action of rubbing it into a supply of cosmetic material. During this process some of the cosmetic material is often smeared onto the hand and/or fingers of the person holding the sponge, this can result in the transfer of the smeared cosmetic material from the user's hand and/or fingers into other cosmetic materials being applied in subsequent applications. This can be costly as the contaminated material must be discarded. Moreover, if the contamination goes unnoticed, an undesired blend of cosmetics and/or colors will be applied to the skin of the recipient.

An additional problem sometimes encountered is due to the lack of resiliency of the particular sponge being used to apply the cosmetic material. Often, the aforementioned sponges are composed of a very soft, low density material making it difficult for the person using the sponge to exert adequate pressure against the skin of the recipient on which the make-up is being applied, thereby resulting in inadequate coverage.

In addition to the foregoing, because the above-described sponges are typically used in contact with human skin, harmful bacteria can be transferred to, and build up on the sponge's surface which, if not removed, can contaminate any make-up with which the sponge comes into contact as well as potentially irritate the skin of any person on which the contaminated sponge or make-up is used. Therefore, it is very important to thoroughly clean and dry these sponges between uses. However, due to their porous nature, the sponges can take long periods of time to dry and are often placed in drawers or plastic bags while still wet, further promoting the formation of bacteria, as well as the degeneration of the sponge itself.

Accordingly, it is the general object of the present invention to provide a cosmetic applicator having sufficient resiliency to allow for the exertion of adequate application pressure against a person's skin while still maintaining an application surface amenable to the smooth and continuous application of make-up.

Another object of the present invention is to provide a cosmetic applicator which can be thoroughly washed, dried and stored with minimal risk of bacteria production.

SUMMARY OF THE INVENTION

The present invention resides in a cosmetic applicator comprising first and second resilient members having differing densities. The first resilient member defines an interior area and includes a tip end, first and second exterior surfaces, and a lower end having an aperture for providing access to the interior area, the aperture and the interior area being adapted to receive at least two fingers of a user. The second resilient member is attached to the first and second exterior surfaces, and extends over the tip end of the first resilient member. As previously mentioned, the second resilient member has a second density, different from the density of the first resilient member. In the preferred embodiment, the density of the first resilient member is greater than the density of the second resilient member.

Preferably, the cosmetic applicator includes a base coupled to the lower end of the first resilient member. The base defines an aperture extending therethrough and in communication with the aperture in the first resilient member. A first cover for slidably receiving the first and second resilient members is provided and releasably engages the base. The first cover may include a top portion having a plurality of apertures extending therethrough to allow air to reach the first and second resilient members. Additionally, a second cover releasably engageable with the base, for covering the aperture in the base, can also be provided and includes a mesh surface that allows air to circulate in the above-described interior area.

In an alternate embodiment of the present invention, a barrier in the form of a layer of impermeable material can be bonded to an interior surface of the interior area, or a sleeve positioned in the interior area, acts to prevent the ingress of contaminants to, or the egress of contaminants from the interior area of the applicator. Similarly, a barrier can also be provided between the first and second resilient members to minimize contamination.

In another embodiment of the present invention, the previously described base includes a transverse bore adapted to slidably receive and retain a lipstick while the applicator is not in use.

In still another embodiment of the present invention, an applicator support member defining and interior area is provided and includes a tip portion defining a first slot extending into the interior area. The aforementioned first resilient member is coupled to the applicator support member and extends over the tip portion. The first resilient member defines a second slot in communication with the first slot. An applicator retainer is provided and is adapted to receive the second resilient member. The applicator retainer with the second resilient member received therein is removably frictionally retained within the first slot. Accordingly, after use of the cosmetic applicator, the second resilient member and the applicator retainer can be removed and thoroughly cleaned. Alternatively, the second resilient member can be pushed up through the interior area of the applicator support member until it extends out of the first and second slots.

In yet another embodiment of the present invention, the first resilient member is substantially cylindrical and includes a body portion and a first tip. The first resilient member defines an axial bore extending therethrough. The second resilient member includes a second tip portion and is positioned in, retained by, and extends along the entire length of the axial bore in the first resilient member. A sleeve is provided and defines a bore extending therethrough adapted to slidably receive the body portion of the first cylindrical member. A cap defining an interior area adapted to receive the first and second tip portions of the first and second resilient members is provided, and includes an angled surface located in the interior area. A cutter is coupled to the angled surface for trimming the tip portions of the first and second resilient members to expose a fresh cosmetic material application surface. When a fresh, clean application surface is needed, the first and second resilient members can be pushed up out of the sleeve, thereby extending the respective tip portions. The cutter is then actuated, thereby the tips of the first and second resilient members.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE PREFERRED EMBODIMENT

Figure 1:
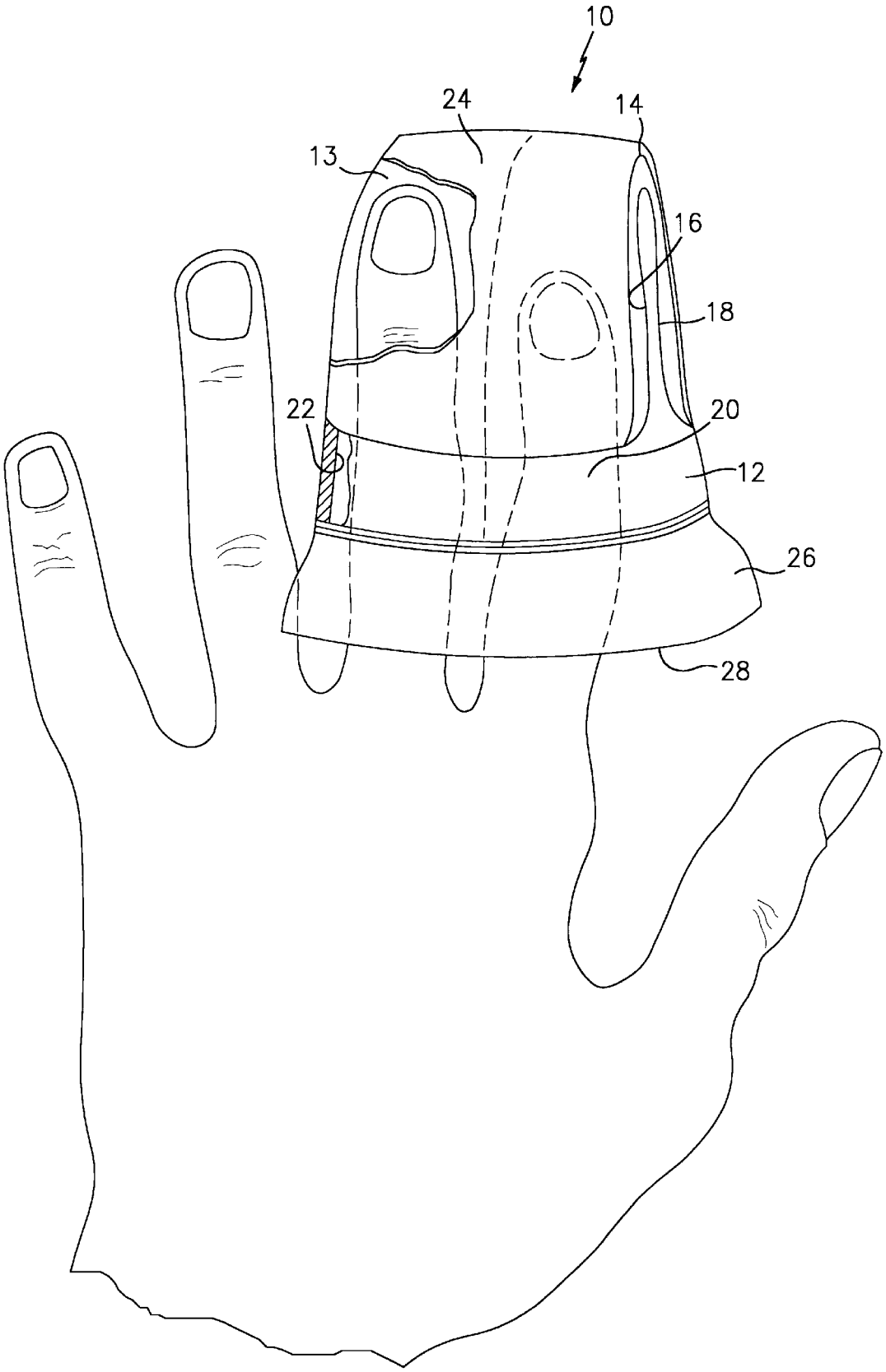
FIG. 1 is a perspective view of the cosmetic applicator of the present invention shown mounted on the hand of a user.
Figure 2:
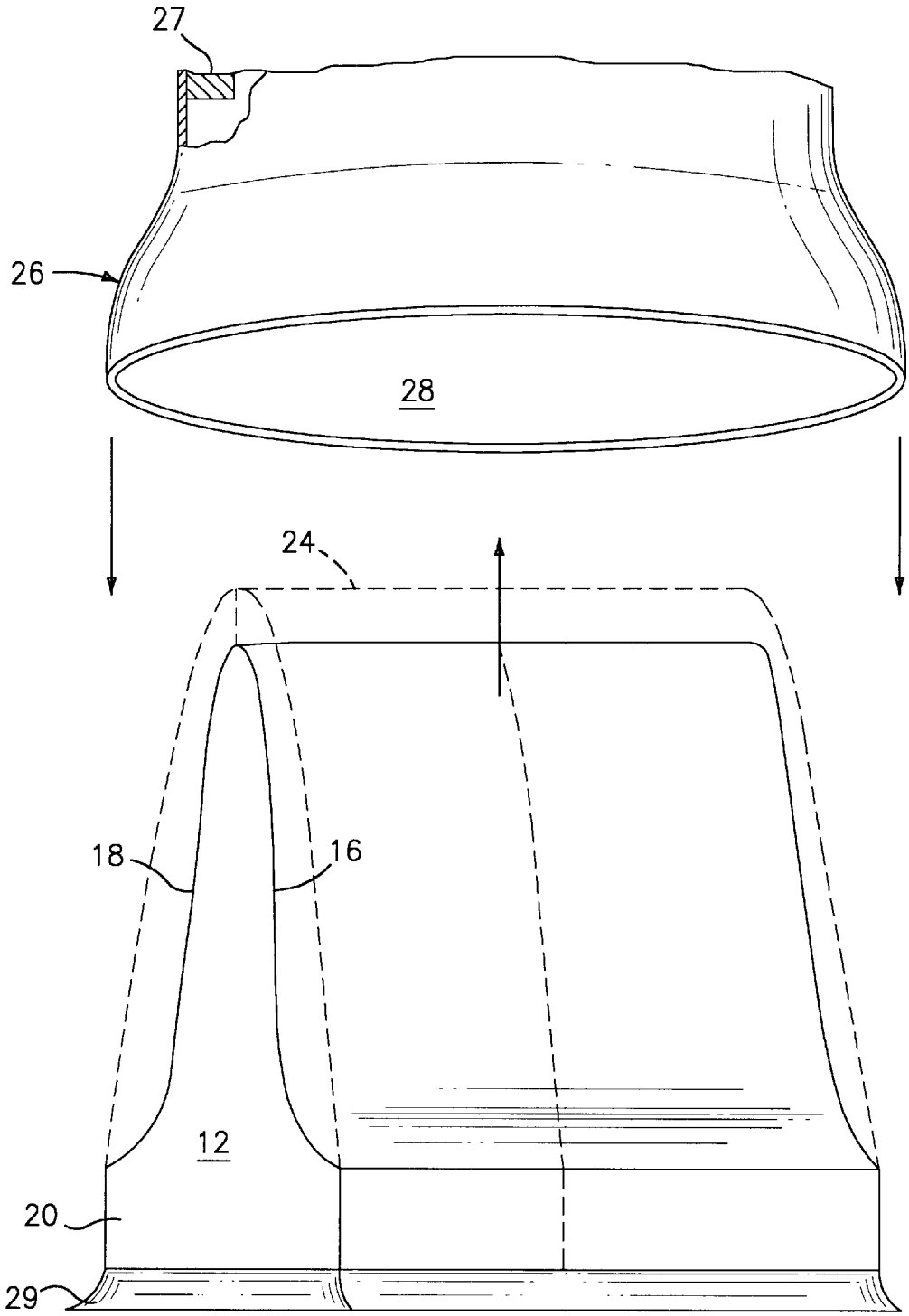
FIG. 2 is a partly in section exploded view of the cosmetic applicator of FIG. 1.

Turning to the drawings and first referring to FIGS. 1 and 2, the preferred embodiment of a cosmetic applicator for applying make-up, there shown and generally designated as 10, comprises a first resilient member 12 having a first density, an interior area 13, a tip end 14, and first and second exterior surfaces 16 and 18 respectively. The first resilient member 12 also includes a lower end 20 that defines an aperture 22, thereby providing access to the interior area 13. A second resilient member 24 having a second density is attached to the first and second exterior surfaces, 16 and 18 respectively, extending over and covering the tip end 14 of the first resilient member 12. A base 26 defining an aperture 28 extending therethrough for receiving the first and second resilient members, 12 and 24 respectively is provided. The first and second resilient members, 12 and 24, are positioned in the base by sliding the resilient members through the aperture 28 until a first lip 29 defined by the first resilient member 12 abuts a second lip 27 defined by the base 26. The first and second resilient members ,12 and 24 respectively, are made from a suitable material, such as, but not limited to a foam or foam rubber. In the preferred embodiment of the present invention, the aforementioned first density is greater than the second density.

Still referring to FIGS. 1 and 2, the aperture 28 in the base 26 and the interior area 13 of the first resilient member cooperate to define holding means for allowing a user to manipulate the cosmetic applicator 10. In the illustrated embodiment, the user can position at least two fingers within the interior cavity 13 of the first resilient member.

Figure 3:
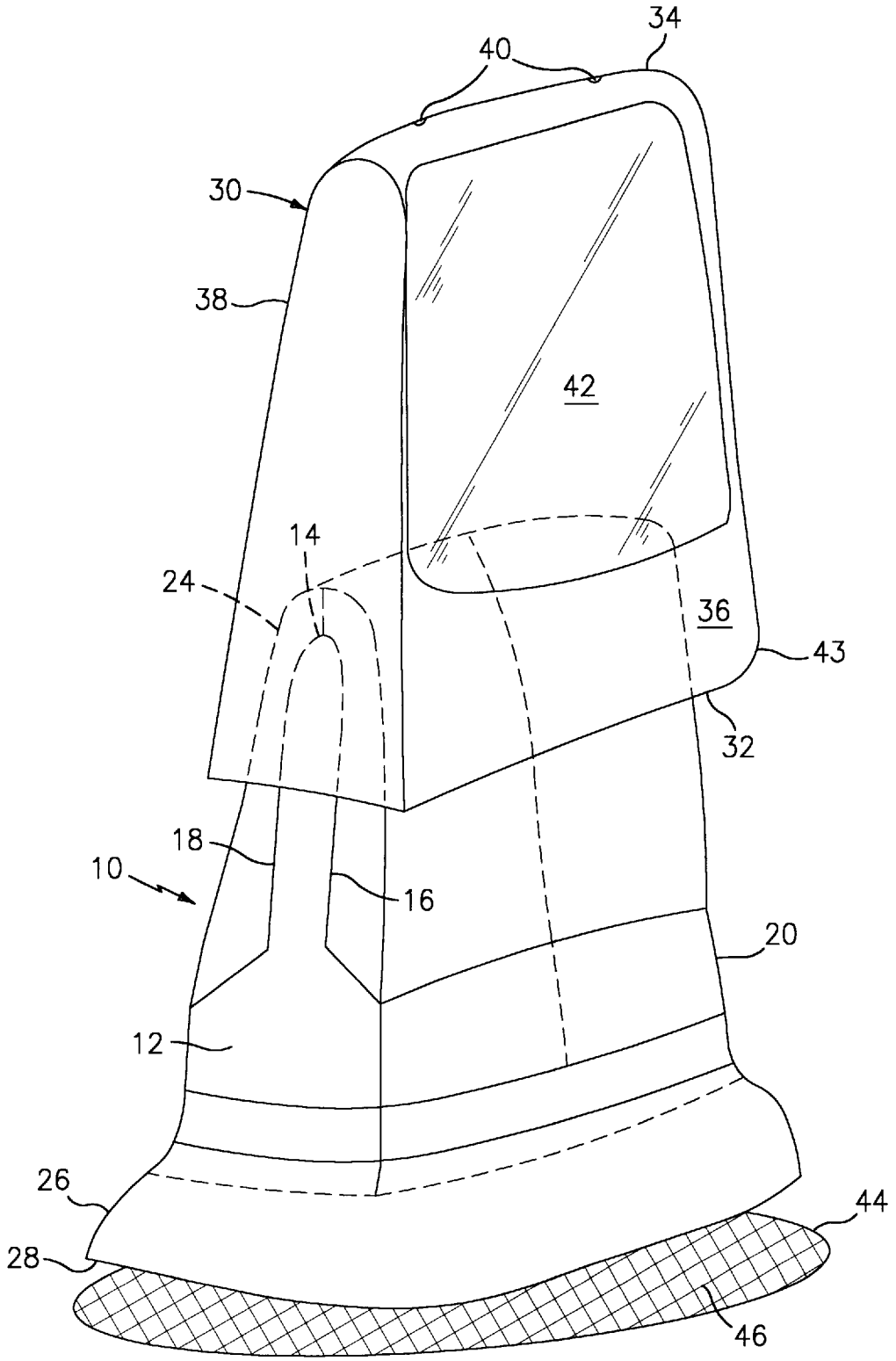
FIG. 3 is a perspective, exploded view of the cosmetic applicator of FIG. 1 sowing the first and second covers.

Referring to FIG. 3, a first cover 30 defining an interior area 32 for slidably receiving the first and second resilient members 12 and 24 respectively, is provided and includes a top section 34, and front and rear surfaces 36 and 38. The top section 34 defines a plurality of apertures 40 extending therethrough to allow air to reach the second resilient member 24, when the first cover 30 is positioned over the first and second resilient members, 12 and 24. In addition a mirror 42 can be coupled to either one of the front or rear surfaces, 36 or 38 respectively, of the first cover 30. The first cover 30 further includes a lower portion 43 releasably engageable with the base 26, thereby protecting the first and second resilient members 12 and 24 respectively.

Still referring to FIG. 3, a second cover 44, preferably defining a meshed surface 46 is releasably engageable with the base 26 and covers the aperture 28 leading to the interior area 13. Accordingly, when the first and second covers, 30 and 44, respectively are both engaged with the base 26, air can circulate through the plurality of apertures 40 in the top portion 34 of the first cover as well as through the mesh surface 46 of the second cover, thereby allowing the sponge to thoroughly dry after cleaning, and to remain dry until it is used.

Figure 4:
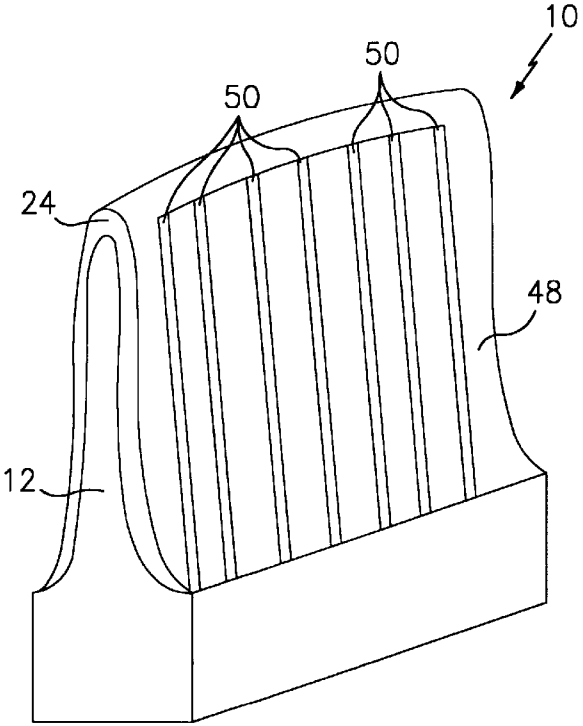
FIG. 4 is a perspective view of an alternate embodiment of the first and second resilient members of the cosmetic applicator of FIG. 1.
Figure 5:
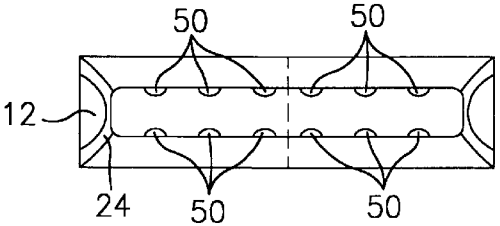
FIG. 5 is a top plan view of the cosmetic applicator of FIG. 3.

In an alternate embodiment of the cosmetic applicator 10, shown in FIGS. 4 and 5 the second resilient member includes an exterior surface 48 that defines a plurality of longitudinally extending striations 50 for receiving and retaining a cosmetic material to be applied to the skin of a recipient.

Figure 6:
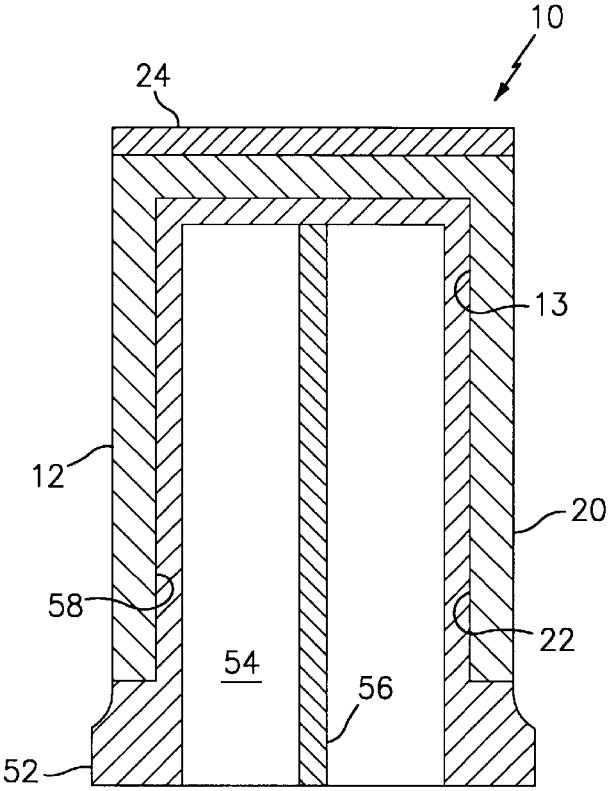
FIG. 6 is a cross-sectional view of an alternate embodiment of the cosmetic applicator of FIG. 1.

In another embodiment of the present invention shown in FIG. 6, instead of the previously described base 26, FIG. 2 , the cosmetic applicator 10 includes a sleeve 52 positioned in the interior area 13 defined by the first resilient member 12. The sleeve 52 defines an interior cavity 54 for receiving the at least two fingers of the user. The sleeve can also include at least one partition 56 for separating the fingers of the user. The sleeve is made of a suitable material, such as, but not limited to a polymer. In operation, the sleeve acts as a barrier to prevent contamination of the first resilient member from the fingers of the user. While a sleeve is illustrated and described herein, the invention is not limited in this regard as those skilled in the art will recognize that there are other methods, one of which is described below, for preventing contamination of an interior surface 58 of the first resilient member 12.

Figure 7:
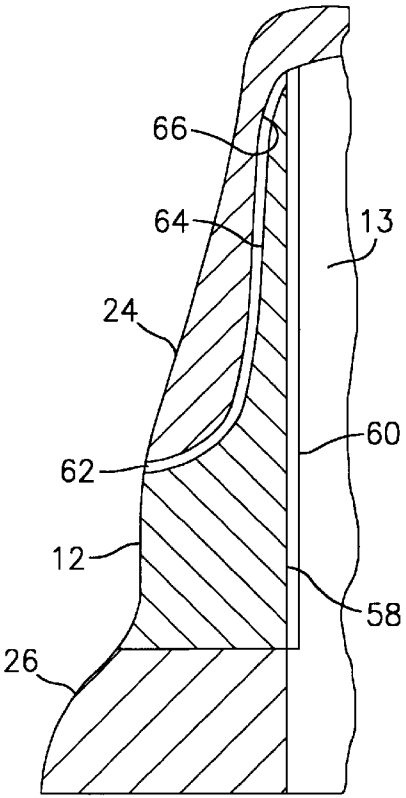
FIG. 7 is a partial, cross-sectional view of an alternate embodiment of the cosmetic applicator of FIG. 1.

One such method is illustrated in FIG. 7 wherein an impermeable layer of flexible material 60 is bonded to the interior surface 58 of the first resilient member 12, thereby preventing the ingress of contaminants to, or the egress of contaminants from the interior area 13. Similarly, a flexible impermeable barrier 62 can be interposed between and bonded to an exterior surface 64 of the first resilient member 12 and an interior surface 66 of the second resilient member 24, for preventing the ingress of contaminates from the second to the first resilient member, or the egress of contaminates from the first to the second resilient member.

Figure 9:
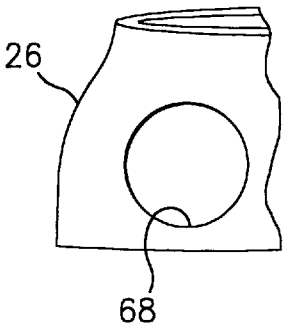
FIG. 9 is a partial side elevational view of the base of the cosmetic applicator of FIG. 5 taken from the right side.
Figure 8:
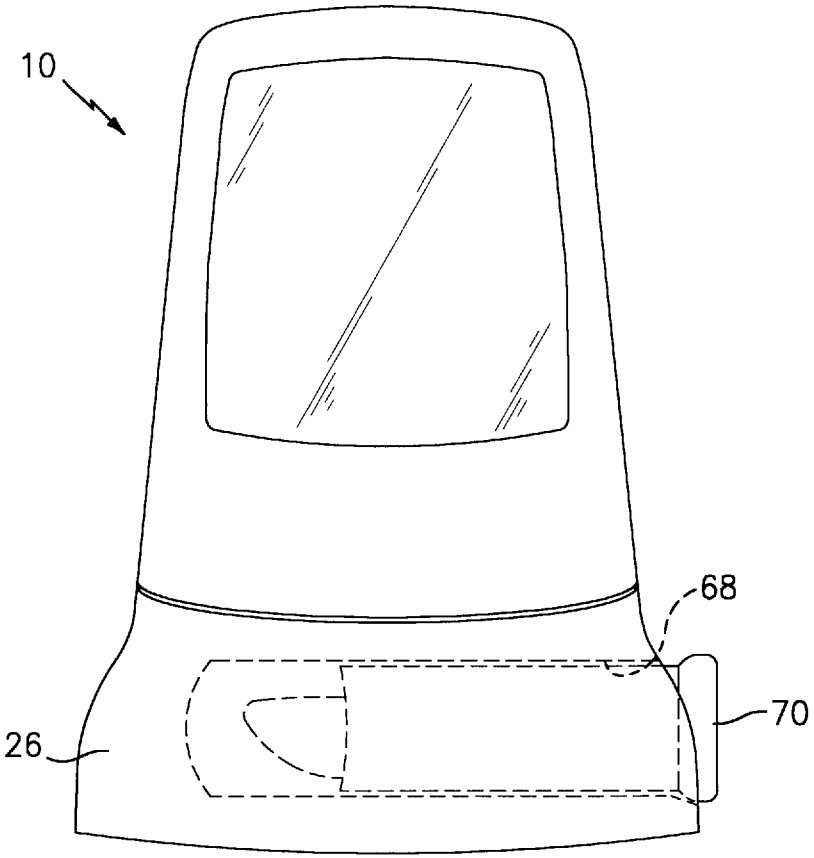
FIG. 8 is a front elevational view of an alternate embodiment of the cosmetic applicator of FIG. 1.

In still a further embodiment of the present invention shown in FIGS. 8 and 9, the base 26 defines a transverse bore 68 for slidably receiving and retaining a lipstick or other cosmetic item 70 in the bore when the cosmetic applicator 10 is not in use.

Referring back to FIG. 1, the cosmetic sponge 10 is used by first sliding two fingers into the interior cavity 13 of the sponge. Next, the second resilient member 24 can be coated with a cosmetic material that can then be applied to the skin of a recipient by rubbing the cosmetic applicator against the skin's surface. The aforementioned disparity in density between the first and second resilient members, 12 and 24 respectively allows the user to apply adequate pressure against the skin of the recipient to insure proper coverage of the cosmetic material. When the user is finished applying cosmetic material, he/she then cleans the applicator and places the first cover 30, FIG. 2 over the first and second resilient members 12 and 24, and places the second cover 44 over the aperture 28 in the base 26. The previously described apertures 40 in the first cover 30 and the mesh surface 46 in the second cover 44 allow air to circulate through the first and second resilient members.

Figure 10:
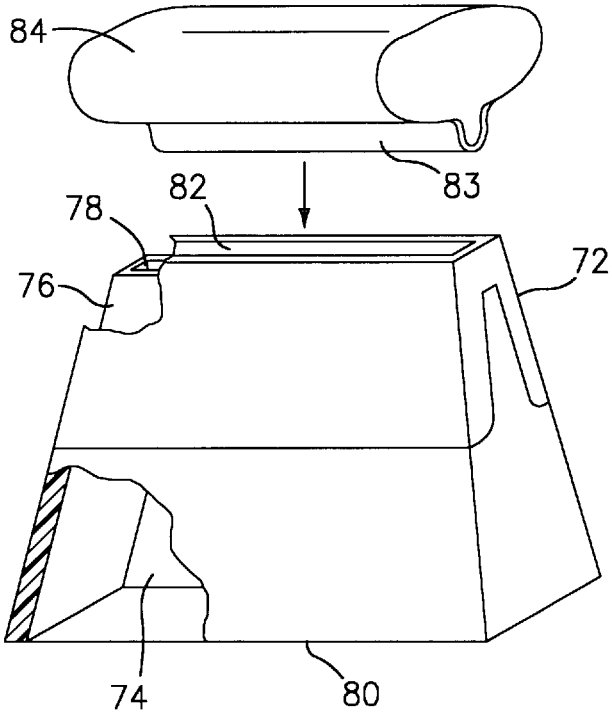
FIG. 10 is a perspective, partly in section, exploded view of an alternate embodiment of the present invention.

While preferred embodiments have been shown and described, various modifications and substitutions may be made without departing from the spirit and scope of the present invention. One such embodiment is shown in FIG. 10, and comprises an applicator support member 72 defining an interior area 74 adapted to receive at least two fingers of a user, and a tip end 76 defining a first slot 78 extending into the interior area. The lower or bottom end of the applicator support member 72 defines an aperture 80 to allow the user's fingers to be inserted into the interior area 74. The applicator support member 72 is made from a suitable material, such as, but not limited to plastic. A first resilient member 81 having a first density is coupled to the applicator support member 72 extending over the tip end 76 and defining a second slot 82 in communication with the first slot 78 in the applicator support member. An applicator retainer 83 is provided and is of a shape complimentary to the first and second slots 78 and 82, such that the applicator retainer can be pressed into and removably, frictionally retained within the first slot 78. A second resilient member 84 having a second density can be removably pressed into and retained by the applicator retainer 83. The first and second resilient members, 81 and 84 respectively, are made of suitable materials, such as, but not limited to a sponge rubber, or foam with the second density preferably being less than the first density. After the cosmetic applicator of the illustrated embodiment is used, the second resilient member 84, as well as the applicator retainer 83 can be removed from the first slot 78 and thoroughly washed. Alternatively, the second resilient member 84 can be replaced with a new applicator member, or with applicator members having differing degrees of resiliency for applying different types of cosmetic material.

Figure 11:
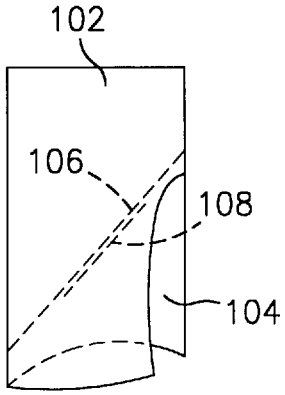
FIG. 11 is a perspective, partly in section view an alternate embodiment of the present invention.
Figure 11:
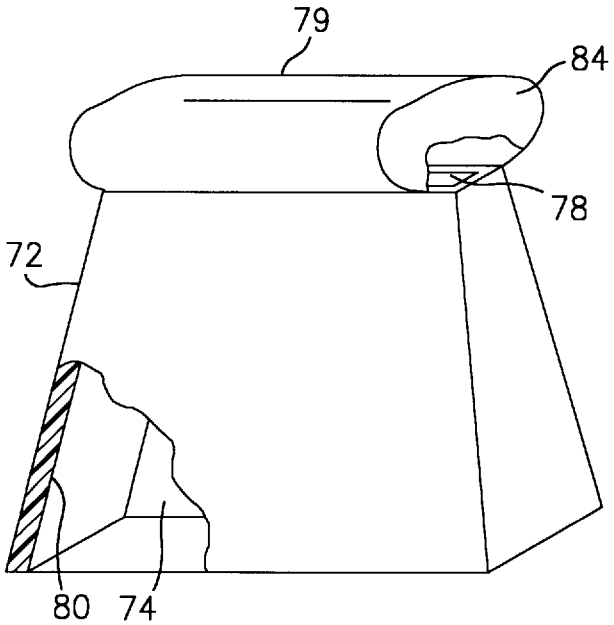

Turning to FIG. 11, instead of the second resilient member 84 being inserted into an applicator retainer and then into a slot, the second resilient member can be pressed into the interior area 74 through the opening 80 and pushed partially through the slot 78 until a portion 79 of the second resilient member 84 extends out of the applicator support member 72. As with the embodiment illustrated in FIG. 10 and described above, the second resilient member 84 of FIG. 11, can be removed for cleaning or replacement with a new and/or different applicator member.

Figure 12:
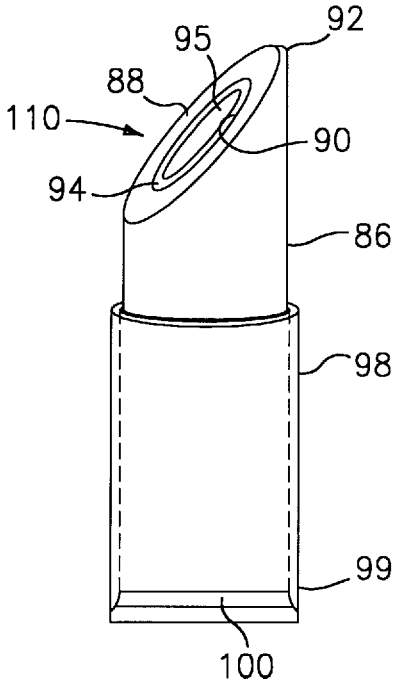
FIG. 12 is a front elevational view of an alternate embodiment of the present invention.

FIG. 12 illustrates another embodiment of the present invention wherein, a substantially cylindrical first resilient member 86 has a first density and includes a first tip portion 88. The first resilient member 86 defines an elongated axial bore 90 extending through the first resilient member and a body portion 92. A second resilient member 94, having a second density, includes a second tip portion 95, and is positioned in, the axial bore 90. Holding means in the form of a sleeve 98 is also provided and defines a bore 100 extending therethrough slidably receiving the body portion 92 of the first resilient member 86. A cover 102 defining an interior area 104 adapted to receive the first and second tip portions 88 and 95 of the first and second resilient members 86 and 94 respectively, is also included. The cover 102 further defines an angled surface 106 located within the interior area 104. A cutter 108 is coupled to the angled surface 106 for trimming the tip portions 88 and 95 of the first and second resilient members 86 and 94 respectively, to expose a fresh cosmetic material application surface 110. In operation, after the applicator has been used to apply cosmetic material to the skin of a recipient, the user can either remove the applicator member 86 from the sleeve 98 and wash it, or he/she can use the cutter 108 to trim the tip of the applicator to expose a clean cosmetic material application surface 110. This is accomplished by pushing the first and second resilient members 86 and 94 respectively, upward using a finger inserted into the bore 100 from the lower portion 99 of the sleeve 98. The cover 102 is then positioned over the exposed portion of the first and second resilient members 86 and 94 respectively, and the cutter 108 is actuated, thereby trimming off a portion of the first and second resilient members and exposing a clean application surface 110.

Accordingly, it is to be understood that the present invention has been described by way of example and not by limitation.

What is claimed is:

1. A cosmetic applicator comprising:

a first resilient member having a first density, a tip end, a lower end, exterior surfaces, and an interior defined by an interior surface, the first resilient member further defining an aperture located at the lower end and in communication with the interior area, the aperture being adapted to receive at least two fingers of the user;

a second resilient member, for retaining and depositing a cosmetic material, coupled to the first resilient member and having a second density; and a sleeve positioned in the interior area and defining an interior cavity for receiving the at least two fingers of the user.

2. A cosmetic applicator as defined by claim 1, wherein the cosmetic applicator further comprises means for preventing the ingress or egress of contaminants to or from the interior area.

3. A cosmetic applicator as defined by claim 2, wherein the means for preventing the ingress or egress of contaminants to or from the interior area comprises:

an impermeable layer of material bonded to the interior surface.

4. A cosmetic applicator as defined by claim 1, wherein the interior cavity of the sleeve includes at least one partition for separating the at least two fingers of the user received in the interior cavity.

5. A cosmetic applicator as defined by claim 1, wherein the sleeve is formed from a polymeric material.

6. A cosmetic applicator as defined by claim 1, wherein:

the second resilient member is coupled to the exterior surface of the first resilient member extending over the tip end;

the second resilient member further includes an interior and an exterior surface; and wherein the cosmetic applicator further includes a flexible impermeable barrier interposed between and bonded to the exterior surface of the first resilient member and the interior surface of the second resilient member, for preventing the ingress of contaminates from the second to the first resilient member, or the egress of contaminates from the first to the second resilient member.

7. A cosmetic applicator as defined by claim 1, wherein the first density is greater than the second density.

8. A cosmetic applicator as defined by claim 1, further comprising:

a first cover defining a first cover interior for removably receiving the first and second resilient members.

9. A cosmetic applicator as defined by claim 8, wherein the first cover includes a top surface defining a plurality of apertures extending therethrough to allow air to circulate in the first cover interior.

10. A cosmetic applicator as defined by claim 8, wherein the first cover further includes:

a front and rear surface;

and a mirror coupled to a respective one of the front or rear surfaces.

11. A cosmetic applicator as defined by claim 1, further comprising a first cover defining a first cover interior for removably receiving the first and second resilient members; and wherein the sleeve includes a lower portion for releasably retaining the base portion of the first cover.

12. A cosmetic applicator as defined by claim 11, wherein the first cover includes a top surface defining a plurality of apertures extending therethrough to allow air to circulate in the first cover interior.

13. A cosmetic applicator as defined by claim 11, wherein the first cover further includes front and rear surface and a mirror coupled to a respective one of the front or rear surfaces.

14. A cosmetic applicator as defined by claim 11, wherein:

the first cover includes a lower end; and wherein the cosmetic applicator further comprises a second cover releasably engageable with the lower end of the first cover.

15. A cosmetic applicator as defined by claim 8, wherein the first resilient member includes a lower and, and wherein the cosmetic applicator further comprises a base removably coupled to the lower end of the first resilient member, the base defining an aperture extending therethrough and in communication with the aperture in the first resilient member; and wherein the first cover is releasably engageable with the base.

16. A cosmetic applicator as defined by claim 15, further comprising a second cover releasably engageable with the base for covering the aperture defined by the base.

17. A cosmetic applicator as defined by claim 16 wherein the second cover defines a mesh surface, thereby allowing air to circulate through the second cover and into the interior cavity.

18. A cosmetic applicator as defined by claim 16 wherein the base defines a transverse bore for slidably receiving a lipstick.

19. A cosmetic applicator as defined by claim 1, wherein the sleeve includes a base portion extending past a lower end of the first resilient member, the base portion defining a transverse bore for slidably receiving a lipstick.

20. A cosmetic applicator as defined by claim 1, wherein the second resilient member defines a plurality of longitudinally extending striations for receiving and retaining a cosmetic material.

21. A cosmetic applicator as defined by claim 1, wherein the holding means comprises:

an applicator support member defining an interior area, a tip end defining a first slot extending into the interior area, and a bottom end defining an aperture extending into the interior area, the aperture and the interior area being adapted to receive at least two fingers of a user; and wherein the cosmetic applicator further comprises the first resilient member being coupled to the applicator support member extending over the tip end and defining a second slot in communication with the first slot;

an applicator retainer removably frictionally retained by the first slot and adapted to removably receive and retain the second resilient member.

22. A cosmetic applicator as defined by claim 1, wherein the holding means comprises:

an applicator support member defining an interior area, a tip end defining a slot extending into the interior area, and a bottom end defining an aperture extending into the interior area, the aperture and the interior area being adapted to receive at least two fingers of a user; and wherein the second resilient member is slidably removably received in the interior area and a portion of the second resilient member extends though the slot in the applicator support member.

23. A cosmetic applicator as defined by claim 1, wherein the first resilient member is substantially cylindrical and includes a body portion and first a tip portion, the first resilient member defining an elongated axial bore extending therethrough;

the second resilient member includes a second tip portion, and is positioned in the elongated axial bore;

the holding means comprises a sleeve defining a bore extending therethrough for slidably receiving the body portion of the first resilient member; and wherein the cosmetic applicator further comprises a cover defining an interior area adapted to receive the first and second tip portions, and including an angled surface located within the cover interior area; and a cutter coupled to the angled surface for trimming the tip portions of the first and second resilient members.

* * * * *